US009376818B1

(12) United States Patent
Kelly

(10) Patent No.: US 9,376,818 B1
(45) Date of Patent: Jun. 28, 2016

(54) APPARATUS FOR APPLYING A SHEET OF FABRIC ACROSS A SURFACE OF A ROOF DECK DURING COATING AND METHOD OF USING THE SAME

(71) Applicant: Matthew M Kelly, Cataño, PR (US)

(72) Inventor: Matthew M Kelly, Cataño, PR (US)

( * ) Notice: Subject to any disclaimer, the term of this patent is extended or adjusted under 35 U.S.C. 154(b) by 186 days.

(21) Appl. No.: 14/187,212

(22) Filed: Feb. 21, 2014

Related U.S. Application Data

(60) Provisional application No. 61/767,427, filed on Feb. 21, 2013.

(51) Int. Cl.

| | |
|---|---|
| ***E04F 13/07*** | (2006.01) |
| ***C09J 5/00*** | (2006.01) |
| ***B29C 65/52*** | (2006.01) |
| ***B32B 37/12*** | (2006.01) |
| ***B32B 37/18*** | (2006.01) |
| ***B32B 38/18*** | (2006.01) |
| ***B32B 39/00*** | (2006.01) |
| ***B32B 43/00*** | (2006.01) |
| ***E04D 15/06*** | (2006.01) |
| ***E04D 5/14*** | (2006.01) |
| ***E04D 5/02*** | (2006.01) |

(52) U.S. Cl.
CPC *E04D 15/06* (2013.01); *E04D 5/02* (2013.01); *E04D 5/148* (2013.01)

(58) Field of Classification Search
USPC ..... 156/71, 305, 307.1, 307.3, 391, 494, 156/538, 543, 547, 580, 581
See application file for complete search history.

(56) References Cited

U.S. PATENT DOCUMENTS

| | | | | | |
|---|---|---|---|---|---|
| 2,176,891 | A | * | 10/1939 | Crom | B08B 9/051 118/305 |
| 3,096,225 | A | * | 7/1963 | Carr | D04H 3/02 118/315 |
| 3,625,804 | A | * | 12/1971 | Losey | E04D 15/06 156/575 |
| 3,900,102 | A | * | 8/1975 | Hurst | C09J 7/0271 156/71 |
| 3,935,353 | A | * | 1/1976 | Doerfling | B44C 1/105 296/1.08 |
| 3,954,544 | A | * | 5/1976 | Hooker | E04D 7/00 156/356 |
| 3,996,396 | A | * | 12/1976 | Hansen | E04D 7/00 156/280 |
| 4,016,323 | A | * | 4/1977 | Volovsek | B32B 5/18 156/78 |
| 4,087,296 | A | * | 5/1978 | Hooker | E04D 7/00 156/357 |
| 4,221,628 | A | * | 9/1980 | Rosenberg | E04D 15/06 156/577 |
| 4,233,356 | A | * | 11/1980 | Jacobs | E01D 19/083 14/73 |
| 4,421,581 | A | * | 12/1983 | Olsen | E04D 11/02 156/71 |

(Continued)

*Primary Examiner* — Sing P Chan
(74) *Attorney, Agent, or Firm* — Hoglund & Pamias, PSC; Roberto J. Rios

(57) ABSTRACT

The apparatus of the invention in conjunction with the spraying unit will unroll the fabric, form it to the shape of the existing profile, and embed the fabric in the applied coating. Not only does the method greatly enhance the quality of the installation providing fewer wrinkles and bubbles, but also its construction greatly protects the roof deck against the effects of the environment. The apparatus of the invention requires fewer workers to operate and sequentially organizes every step reducing safety issues.

27 Claims, 7 Drawing Sheets

(56) References Cited

U.S. PATENT DOCUMENTS 4,442,148 A * 4/1984 Stierli ..... E04B 1/66 428/144
4,535,920 A * 8/1985 Troup ..... B05C 5/02 222/513
4,545,847 A * 10/1985 Schneller ..... B29C 65/54 156/574
4,737,213 A * 4/1988 Paeglis ..... B29C 66/73921 156/157
4,742,992 A * 5/1988 Allen ..... B25B 7/00 254/199
4,761,201 A * 8/1988 Nichols, Jr. ..... E04D 15/06 156/497
4,799,982 A * 1/1989 Vicino ..... B28B 7/22 156/71
5,072,097 A * 12/1991 Miller ..... B29C 65/20 156/359
5,381,597 A * 1/1995 Petrove ..... E04D 15/02 227/111
5,591,289 A * 1/1997 Souders ..... B29C 70/088 156/148
5,670,178 A * 9/1997 West ..... B29C 44/1219 425/224
5,766,395 A * 6/1998 Bainbridge ..... B27N 5/00 156/222
5,927,609 A * 7/1999 Scarpa ..... B05B 7/1431 239/146
5,964,418 A * 10/1999 Scarpa ..... B05B 7/1495 239/424
6,136,379 A * 10/2000 Scarpa ..... B05B 7/1495 427/422
6,416,854 B2 * 7/2002 Hunter, Jr. ..... B05B 13/005 428/306.6
6,458,423 B1 * 10/2002 Goodson ..... B32B 13/00 106/690
6,586,080 B1 * 7/2003 Heifetz ..... B29C 63/0017 428/188
6,679,018 B2 * 1/2004 Georgeau ..... E04D 5/12 52/408
6,864,195 B2 * 3/2005 Peng ..... B32B 27/08 442/2
6,955,012 B2 * 10/2005 Suzuki ..... E04B 7/20 52/198
7,249,443 B2 * 7/2007 Faulkner ..... B32B 5/18 52/409
7,261,933 B2 * 8/2007 Gorowicz ..... B60R 13/0225 296/214
7,631,678 B2 * 12/2009 Cartier ..... B23K 28/00 156/497
8,245,475 B1 * 8/2012 Thomson ..... E04D 1/20 52/478
8,262,833 B2 * 9/2012 Dyal ..... E04D 15/04 156/272.2
8,701,367 B2 * 4/2014 Georgeau ..... E04D 5/12 428/141
2002/0004346 A1 * 1/2002 Hunter, Jr. ..... B05B 13/005 442/100
2003/0051419 A1 * 3/2003 Suzuki ..... E04B 7/20 52/90.1
2003/0145546 A1 * 8/2003 Georgeau ..... E04D 5/12 52/408
2004/0033741 A1 * 2/2004 Peng ..... B32B 27/08 442/38
2004/0107662 A1 * 6/2004 Georgeau ..... E04D 5/12 52/408
2005/0210808 A1 * 9/2005 Larson ..... B32B 27/12 52/555
2006/0237994 A1 * 10/2006 Ludwig ..... B29C 44/14 296/191
2007/0266660 A1 * 11/2007 Davies ..... E04D 5/12 52/309.1
2008/0010933 A1 * 1/2008 Faulkner ..... B32B 5/18 52/411
2008/0210382 A1 * 9/2008 Cartier ..... B23K 28/00 156/497
2009/0017226 A1 * 1/2009 Dyal ..... E04D 15/04 427/561
2011/0000611 A1 * 1/2011 Marzouki ..... E04D 15/04 156/272.8
2011/0097485 A1 * 4/2011 Breeden ..... B05B 7/1486 427/186
2012/0198787 A1 * 8/2012 Mo ..... E04B 1/66 52/741.4
2014/0239546 A1 * 8/2014 Santoni ..... B62D 29/046 264/265
2015/0118401 A1 * 4/2015 Baker ..... E04D 15/04 427/355

* cited by examiner

APPARATUS FOR APPLYING A SHEET OF FABRIC ACROSS A SURFACE OF A ROOF DECK DURING COATING AND METHOD OF USING THE SAME

FIELD OF THE INVENTION

The present invention relates to an apparatus for applying a sheet of fabric across a surface of a roof deck and the method of using the apparatus.

BACKGROUND OF THE INVENTION

In the waterproofing industry many coating systems are applied with rolled fabric embedded in the coating to reinforce seams or cracks in the existing substrate. Generally, this is performed on a smooth surface where directly unrolling the fabric and removing any wrinkles on the roll is relatively easy and "straight forward". However, there are other surfaces like a metal deck, where the surface profile is more complex, an as a consequence the process of applying the fabric is time consuming. Moreover, to make it worst even with a light wind, this process becomes extremely difficult and almost impossible to perform without sacrificing the quality in the final product.

Many styles of surface profiles are currently available on the market provided by different manufacturer with different specifications. Also, there are instances where the profiles can differ dimensionally (even on the same site) sometimes due to poor handling during installation and/or foot traffic after the installation.

There are two methods commonly used in the market to perform the coating operation:

Method 1

This method is generally slow and labor intensive. In this method, coating is applied to the deck by either: a brush, a roller or spray equipment. The fabric is then unrolled and placed in the coating, where immediately 2 or 3 workers will resolve and/or brush out the wrinkles. An additional worker recoats the fabric and it is then allowed to dry.

Method 2

The second method although quick, typically has reduced surface quality, and has a number of safety issues in terms of full OSHA compliance. In this method a worker sprays directly from overhead applying the coating to the substrate. While the substrate is still wet, a second worker walks quickly backwards (almost running) unspooling the fabric directly over the profile. Simultaneously, the original worker sprays the fabric down over the profile with the force of the spray to effectively recoat the fabric. This complete operation must be closely coordinated so that the original layer of coating does not dry before embedding the fabric and the unrolling and re-spraying of the fabric must happen within 8 inches to 12 inches of each other. Finally, single directional spraying over a multi-angled profile does not allow for an even coating application.

In the coating application field, whether in roof coating or car painting, the key is a timely, even coat that sufficiently covers the entire surface. Most people will typically refer to a proper "application technique", particularly when discussing spray applications (but viable with rollers, and brushes as well). Even for those people knowledgeable and experienced about the proper application technique is almost impossible to maintain that level of technique throughout the day because of various obstacles, physical tiredness and lack of concentration. Average variances of up to 400% have been found on single jobs with instances of even greater variance.

Attaining a high and constant precision application as reasonable under the existing conditions is particularly important in the waterproofing field, because except for specific circumstances, the applied waterproofing will wear off/deteriorate at the same rate across the entire exposed surface. So, an uneven application will reach full deterioration sooner in the thinner locations yet delayed (with arguably wasted coating product) at the thicker locations.

To better understand the importance of attaining a high and constant precision application lets first look at some of the variables that might occur during a typical application.

Brushes/Brooms

Using brushes and brooms greatly slows down the process and will limit the area covered. Also, more already dried edges are accumulated that will in turn get recoated and the coating build up is thus, doubled. Add to that the fact that natural contours are left by the bristles (ranging depending on the quality), and a truly uneven surface application is achieved.

Rollers

Rollers, although probably quicker than using brooms (and thus less of the edge drying/recoating condition) also leave a "textured" finish. The final product would look something like the moon surface with craters and ridges, not necessarily dramatic to the eye, but radically disproportionate with 3 mils (dry) in the craters and typically 7-9 mils (dry) on the ridges.

The recent desire to maintain highly reflective roofs and building exteriors is also hindered by this texture since dirt and moisture are retained in the craters reducing the long-term reflectivity of the installed waterproofing. Additionally, the typical installation leaves twice as much coating following the saturation of the roller leading up to the worker deciding if more paint on the roller is needed.

Hand Spraying

Spraying by hand resolves a number of the previously explained issues. There is less texturing, the work progresses quickly so there is less overlapping on an already dries edge, and a worker that can maintain a good spray technique can apply a reasonably even coat to approximately 15,000 square feet per 8 hour period. The problem is that this technique must be maintained for the full 8 hours. One of the most common variables encountered with this technique is the tip distance to the application surface. This variance happens in many forms as a worker swings the gun side to side the extended distance to the surface must be accounted for. If the gun is swung front to back the spray "fan" becomes close on one side (edge) than the other. If a rib profile is sprayed from the side, the opposite side of the rib is shadowed, if a rib is sprayed from directly overhead (downward) the taper of the rib profile and the ever expanding "fan" from the spray tip interact to apply less paint on the sides of the rib compared to other areas (in fact there will also be naturally more paint on the flat top surface of the rib, than the flat surface of the roof deck directly below). These events coupled with wrist fatigue (fighting with 3000 psi coating ejection at the tip), maintaining concentration over a long period of time and under rough weather conditions, and normal human error adds up as accumulated variance.

Thus, what is needed is an efficient and easy-to-operate apparatus and a method for quickly applying a sheet of fabric across a surface of a roof deck using the same.

SUMMARY OF THE INVENTION

The apparatus of the invention in conjunction with the spraying unit will unroll the fabric, form it to the shape of the existing profile, and embed the fabric in the applied coating.

Not only does the method greatly enhance the quality of the installation providing fewer wrinkles and bubbles, but also its construction greatly protects the roof deck against the effects of the environment. The apparatus of the invention requires fewer workers to operate and sequentially organizes every step reducing safety issues.

BRIEF DESCRIPTION OF THE DRAWINGS

Further features and advantages of the invention will become apparent from the following detailed description taken in conjunction with the accompanying figures showing illustrative embodiments of the invention, in which.

Figure 1:
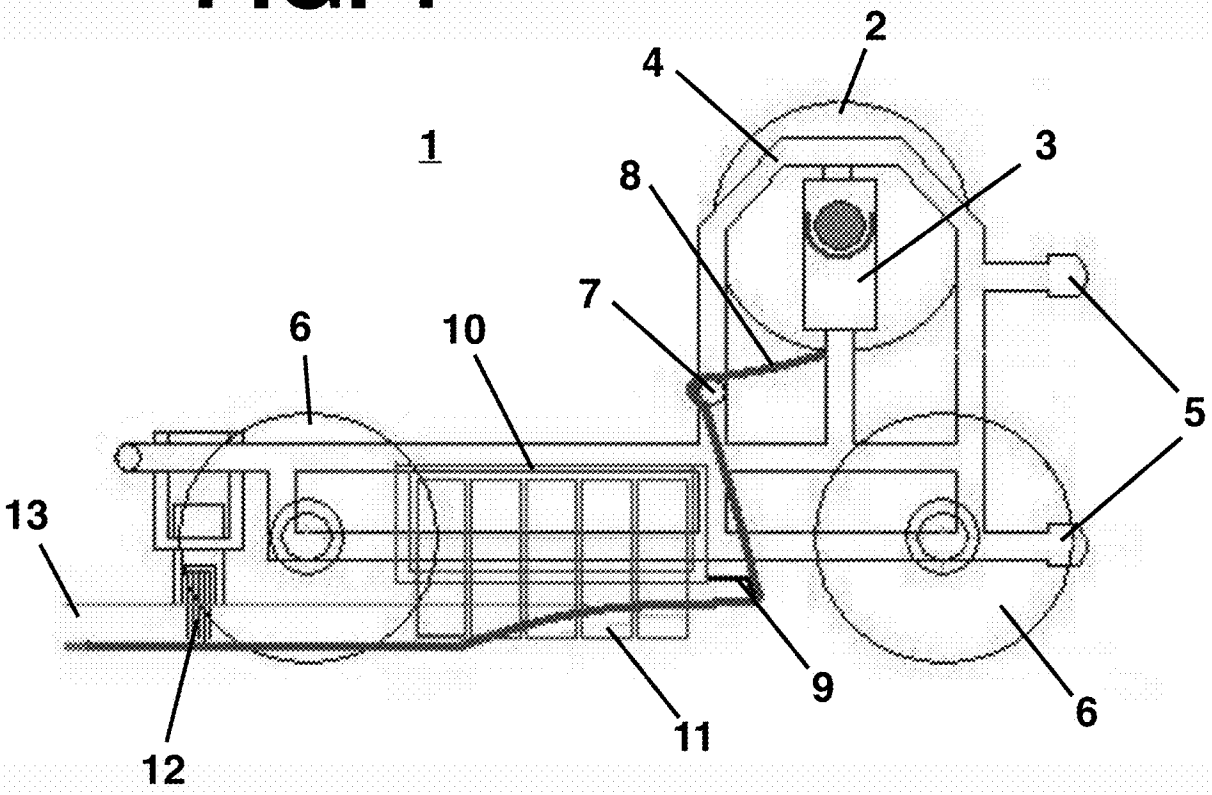
FIG. 1 illustrates a side view of an apparatus according to the present invention.

Throughout the figures, the same reference numbers and characters, unless otherwise stated, are used to denote like elements, components, portions or features of the illustrated embodiments. The subject invention will be described in detail in conjunction with the accompanying figures, in view of the illustrative embodiments.

DETAILED DESCRIPTION OF THE INVENTION

The apparatus of the invention will be now explained in conjunction with FIGS. 1-4. An applying apparatus 1 is provided as one of the principal components of the invention. Applying apparatus 1 has a frame 4 used to couple all the components of the invention. A roll of fabric 2 is positioned on the roll holder 3 that is fixedly coupled to the frame 4. As can be seen, a sheet of fabric 8 from the roll of fabric 2 is directed to a lower part of the apparatus 1 where mould blocks 11 are provided to "mould" the sheet of fabric 8 to conform to the shape of a profile 13 of a roof deck. The mould blocks 11 are positioned inside a mould box 10 that is coupled to the frame 4 of the apparatus 1. As will be explained later in detail, the apparatus 1 with the mould blocks 11 are selectively positioned on top of a profile 13 for gradually applying the sheet of fabric to the profile 13 of the roof deck when a worker moves the apparatus 1. A plurality of wheels 6 (two wheels on each side) is coupled to the frame 4 for facilitating movement of the apparatus 1 when in operation. In a preferred embodiment four wheels are used for stability. In addition, an embedding brush 12 is provided at the near the rear surface of the mould blocks 11 to help embedding the sheet of fabric 8 into the applied coating. A plurality of tensioning bars 7 (only one is shown for clarity) are selectively positioned throughout the frame 4 to ensure that the sheet of fabric is as tensioned at all times. The sheet of fabric 8 can thread through any number of perpendicular tensioning bars 7 to maintain tension on the fabric. However, there are cases where no tension is necessary and the tensioning bars 7 can be omitted. In a preferred embodiment, the tensioning bar 7 is made of steel or any material that remains rigid and straight under constant use. It is very important that the last tensioning bar 7 is selectively positioned so that the unrolled sheet of fabric 8 must make a 90 degrees or greater turn across the straightening bar 9 which is connected to the mould box 10 (not to the frame 4) allowing the straightening bar 9 to remain fixed with the mold box 10 under the possibly varying circumstances.

Figure 3:
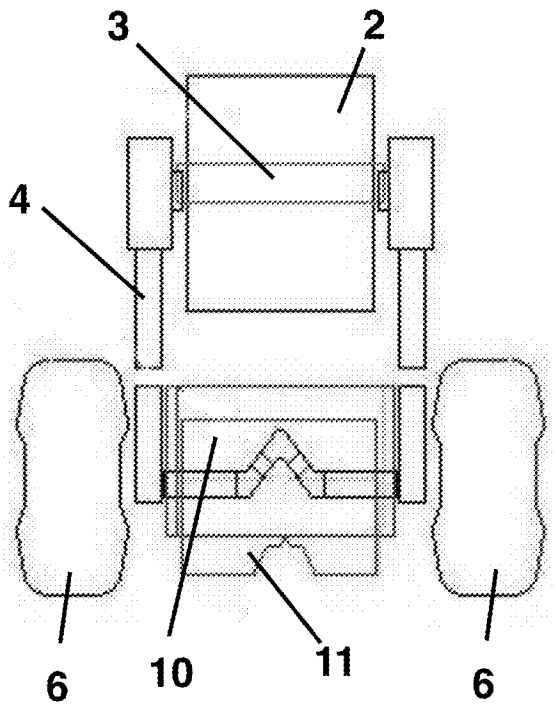
FIG. 3 illustrates a back view of an apparatus according to the present invention.
Figure 2:
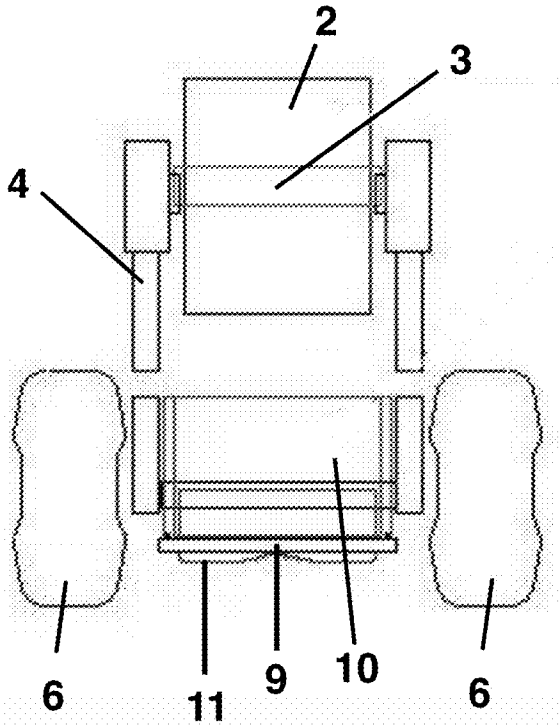
FIG. 2 illustrates a front view of an apparatus according to the present invention.
Figure 6:
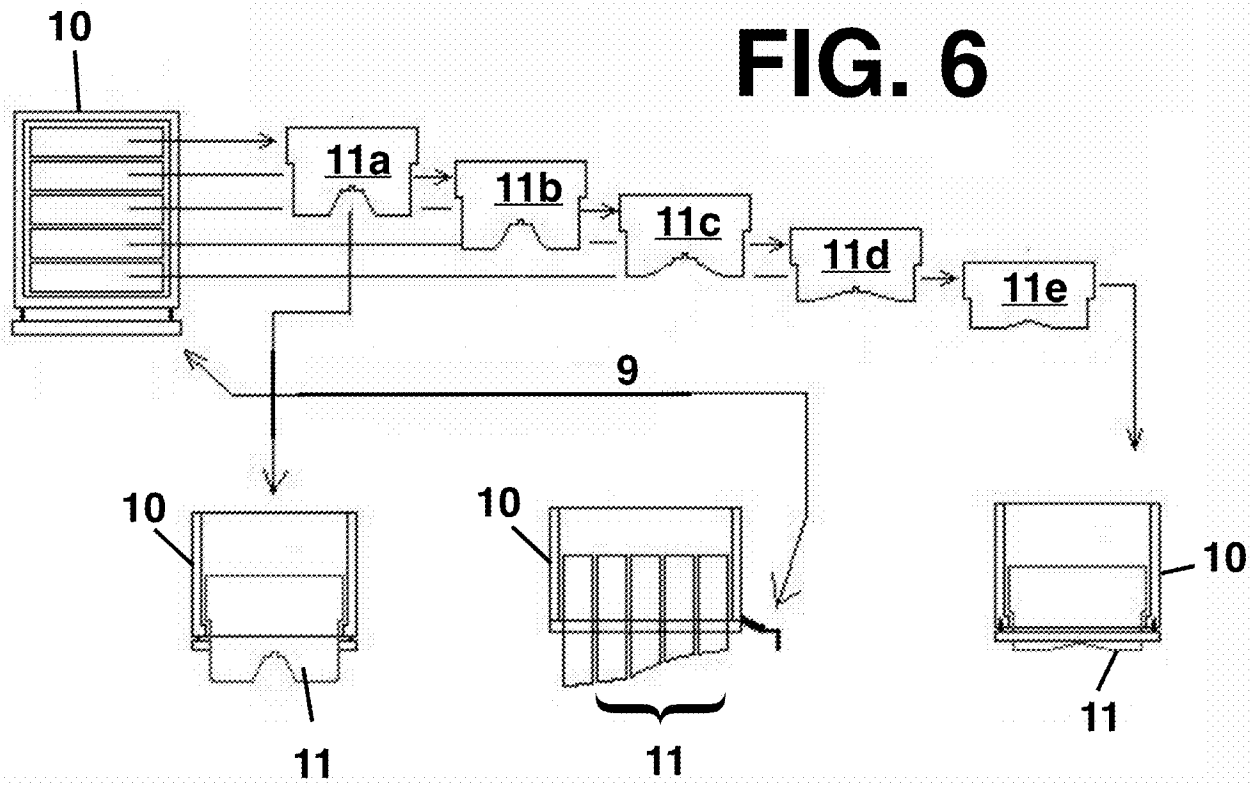
FIG. 6 illustrates a mould box/block arrangement according to the present invention.
Figure 7:
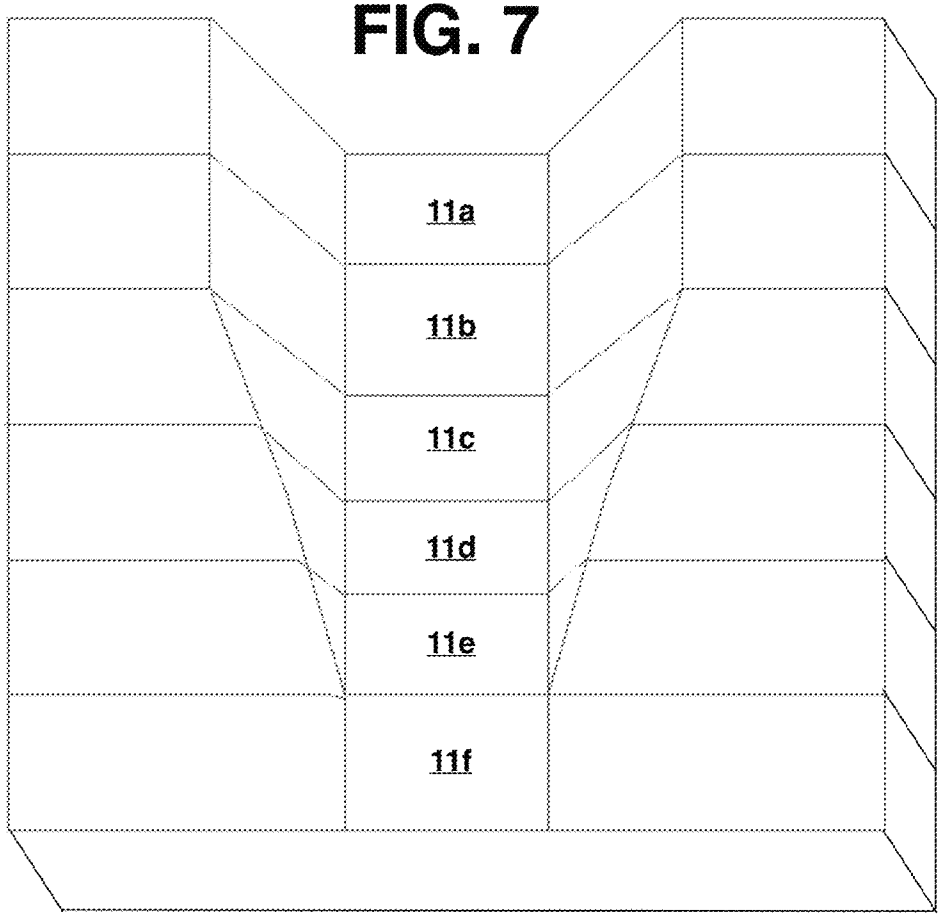
FIG. 7 illustrates a mould block arrangement according to the present invention.

As can be seem on FIGS. 2-3, the mould blocks 11 are selectively positioned to face the roof deck and provide a particular bottom surface configuration. A front surface of the mold blocks 11 has a vertical distance to the roof deck greater (FIG. 2) than the vertical distance from the rear surface of the mould blocks 11 to the roof deck (FIG. 3). This is better understood with FIG. 6, which shows the plurality of mould blocks 11*a*-11*e* having a lower surface with shapes varying from the frontmost mould block 11*e* to the rearmost mould block 11*a*. In operation, the mould blocks 11 are selectively positioned inside a mould box 10 in a side-by-side manner to form a specific surface configuration the conforms to the desired profile for coating. FIG. 7 shows a view of the bottom surface of the mould blocks 11 according to a preferred embodiment of the invention.

In a preferred embodiment, the mold blocks 11 and the mould block 10 are made of wood or a similarly hard but workable material. The mould blocks 11 are clamp them together and from the back end (last block) the exact profile of the deck profile is traced or transferred. Measuring then from the bottom of the mould to the top of the traced profile a line is draw across the face of the first block at that same height. The remaining blocks are then carved or shaped to manipulate the fabric between those two forms (i.e.: the sheet of fabric 8 will come off of the straightening bar perfectly horizontal and that is how it will enter the first mold). After making the transition the sheet of fabric 8 will exit the last mold in the form of the profile. The transition must be smooth, consistent, slow (or timed with the characteristic of the fabric). It is important to ensure that the edges of the mould blocks 11 must be rounded so they do not catch on the sheet of fabric 8. Moreover, it is preferred that the front edge of each block is rounded so that if one is up and one is down for some reason, the sheet of fabric 8 does not snag. For that purpose, 120 to 100 grit sanding is usually sufficient and the fabric passing over during use typically maintains the necessary smoothness.

Figure 5:
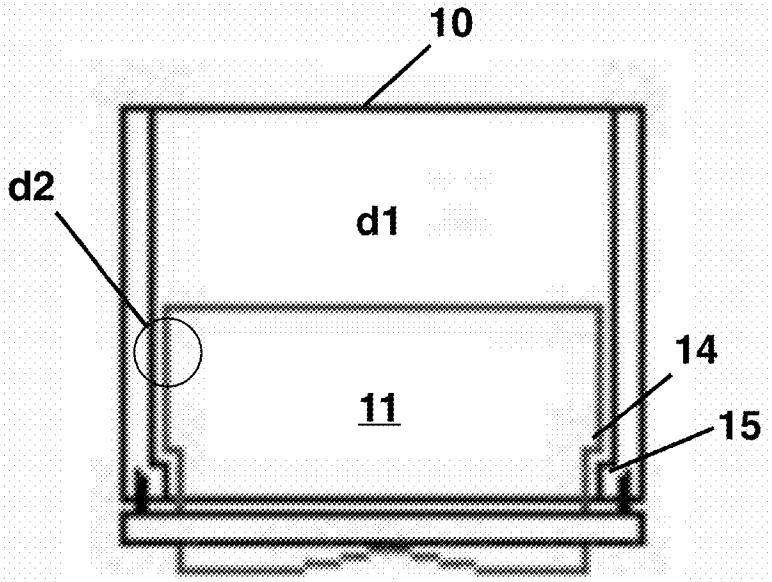
FIG. 5 illustrates a mould box/block detent arrangement according to the present invention.

As shown in FIG. 5, the mould blocks 11 are selectively positioned inside the mould box 10 so that a portion of the mould blocks 11 hang below the mold box 10. The length and number of mold blocks may vary but in a preferred embodiment six 1.5"×7" mould blocks can be used to ensure that the mould blocks have sufficient distance to make the turns and folds that the profiles encountered required. With the 7" width of the mold blocks 11 positioned perpendicular to the fabric length, the mold blocks 11 are stacked front to back within the mould box 10. As can be appreciated in FIG. 5, the mould box 10 is made slightly oversized (by approximately ½" (d2) in both directions so the mould blocks 11 are loose and can function individually if necessary). The bottom edge interior of the mould box 10 has a lip/rail arrangement 14, 15 of approximately ½" protruding to the inside along each side (front to back) and the mould blocks 11 are notched (rabbited) similarly and at about 50% of their height (d1), so they can partially drop through, but then remain hanging at the appropriate height below the container. Moreover, since site conditions of the profile usually vary within a small range of tolerances, the apparatus and particularly the mold sections blocks 11 naturally adjusts itself to these variances.

An important aspect of the invention is the almost every component of the apparatus 1 can be selectively adjusted. The mould box 10 has a height positioning adjustment along its sides so that the distance from the existing deck profile can be adjusted if necessary. This is particularly necessary due to the position of the straightening bar 9 so that it clears fastener heads that may protrude from the roof deck, but without being too far from the profile and creating other difficulties. The wheel width is also adjustable so as to advantageously use the varying profile spacing as guides. In a preferred embodiment, the apparatus 1 holds 4"-8" fabric in a small version. However, since larger fabrics directly influence wheel spacing the dimensions of the apparatus 1 are custom built to the fabric size necessary. Since construction panels vary greatly in their fabricated design, their profile shape and the spacing between profiles, the wheelbase and the moulds blocks are provided adjustable and of differing designs.

Figure 8:
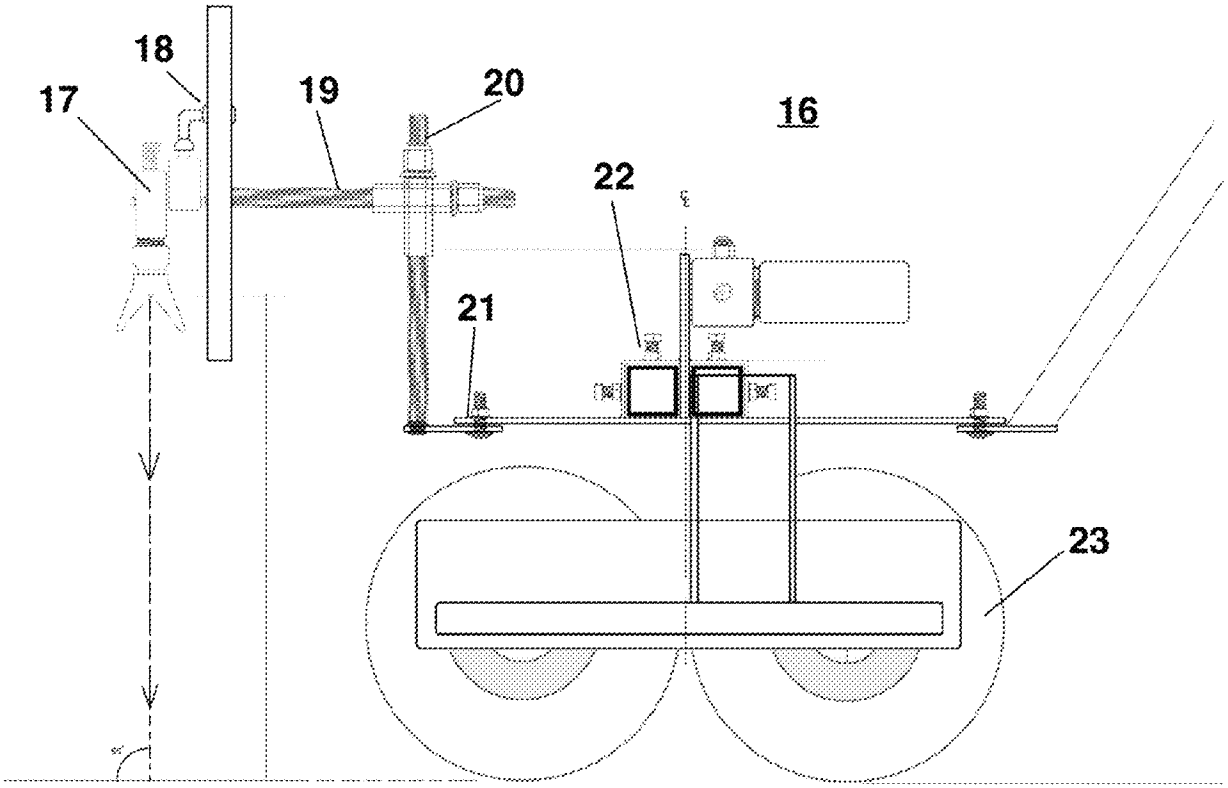
FIG. 8 illustrates a side view of a sprayer unit according to the present invention.
Figure 9:
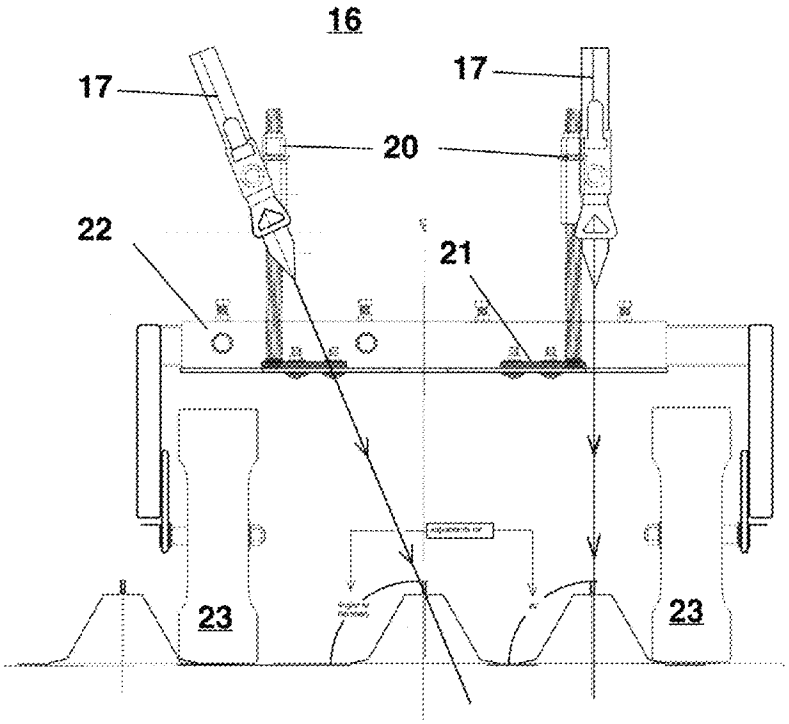
FIG. 9 illustrates a front view of a sprayer unit according to the present invention.

A spraying unit that can be used alone or in combination with the apparatus 1 will be explained in conjunction with FIGS. 8 and 9. The sprayer unit has at least one sprayer tip 17 structurally coupled to a frame. In a preferred embodiment two sprayer tips 17 are used to selectively apply liquid adhesive during the coating process. One important feature of the spraying unit is that almost every component can also be selectively adjusted based on a specific roof deck and profile arrangement. The distance between the sprayer tip 17 and the roof deck is selectively adjusted by a vertical adjusting element 20 that is selectively moved to achieve a desired distance constantly maintaining the precise tip distance from the application surface. In addition, the orientation of the sprayer tip (i.e., fan) to the application surface can be selectively adjusted and constantly maintained by means of a adjusting element 18. This has the added advantage of allowing the worker to use the angle of the fan advantageously to coat the vertical sides of a ribbed profile more evenly.

According to a preferred embodiment, the adjusting arms that support the sprayer tips 17 must be adjustable in height, lateral spacing from center, distance forward from the base, and be able to tilt at the head for directional spraying. The vertical extension arms should also pivot allowing for additional spacing between the tips and off-set positioning. The above-explained adjustments are controlled by selectively manipulating adjusting elements 18-21 as shown in FIGS. 8 and 9. Also, a handle is provided and should be fixed or lockable so the unit can be tipped and "walked" over obstructions.

In the specific case of using the spray unit in conjunction with the apparatus 1 as will be explained later (and for the follow-up saturation coat to that same fabric), the tips can be spread apart and tilted to face directly at the rib-sides; coating more thoroughly, and adding additional security to an important part of the installed system. In addition, with the adjustable wheel span, on many roof surfaces the contour of the deck can be used as a guide and with proper tip settings the overlap is adjustable and minimal with precision similar to products currently available on the market. Using the sprayer unit of the present invention provides additional advantages in regards to safety. The worker would rarely need to cross the 6' perimeter of OSHA guidelines. Since the sprayer unit of the invention provides high stability and ease of operation, its use imposes much less stress on the arm and wrist and the worker can vary his position without affecting productivity or quality throughout the day. According to a preferred embodiment, the sprayer unit must have a minimum of four wheels to guide precisely and to remain stable. The wheel spacing (side to side) could also be adjusted for either added stability and or to adjust to the spacing of the deck ribs. The apparatus 1 (in conjunction with the spraying unit) will unroll the fabric, form it to the shape of the existing profile, and embed the fabric in the applied coating. Not only does the method greatly enhance the quality of the installation (fewer wrinkles and bubbles), but also its construction greatly protects against the effects of the environment.

Figure 4:
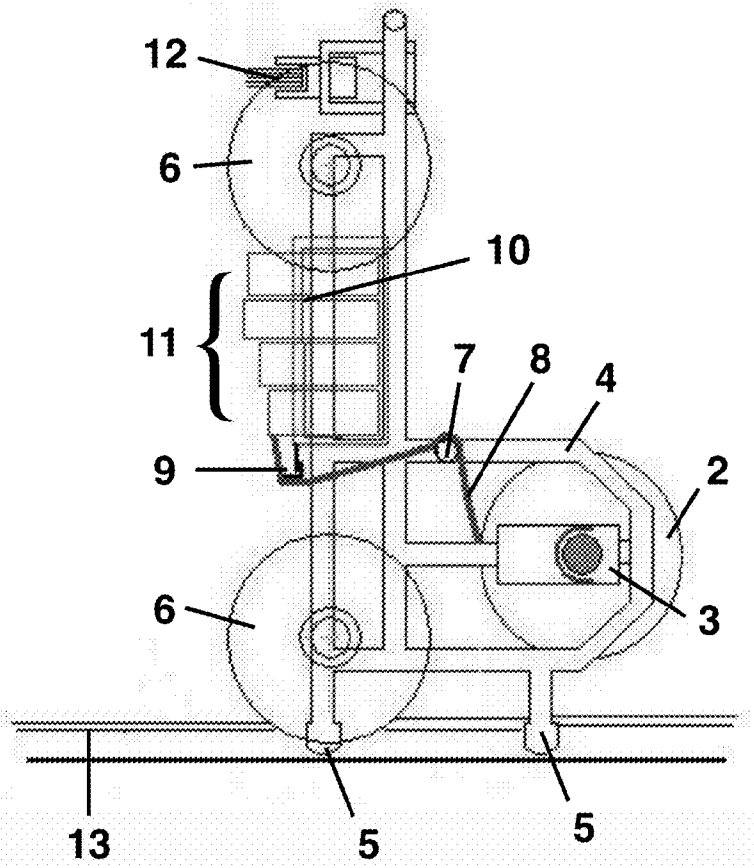
FIG. 4 illustrates a side view of an apparatus in an upright position according to the present invention.

In operation, a worker would manipulate the apparatus 1 by allowing the apparatus to stand on its nose (90 degree position) to allow access to the underside for starting and finishing the length of the profile as shown in FIG. 4. Also, the mould blocks 11 are positioned inside the mould box 10. Afterwards the worker would position the apparatus 1 to an operative position. All the necessary adjustments on the apparatus 1 and the spraying unit are performed to based on the specific deck profile and specific coating treatment. Then, while the liquid adhesive is applied to said roof deck the apparatus 1 is moved along a profile so that the mould blocks arrangement gradually directs the incoming sheet of fabric for applying over said profile. The sprayer unit could be used again to apply the liquid adhesive over the recently applied sheet of fabric to finish the coating process.

Although the present invention has been described herein with reference to the foregoing exemplary embodiment, this embodiment does not serve to limit the scope of the present invention. Accordingly, those skilled in the art to which the present invention pertains will appreciate that various modifications are possible, without departing from the technical spirit of the present invention.

I claim:

1. An apparatus for applying a sheet of fabric from a roll of fabric across a surface of a roof deck having a surface profile, the apparatus comprising:

a frame including a fabric roll holder supporting said fabric roll; and a mould element structurally coupled to said frame and having a top surface, a front surface, a rear surface, lateral surfaces and a bottom surface facing said roof deck and longitudinally extending between said front surface and said rear surface of said mould element, wherein the distance between said bottom surface and said roof deck longitudinally decreases from said front surface to said rear surface so that the distance between said front surface and said roof deck is greater than the distance between said rear surface and said roof deck, said mould element being adapted to receive said sheet of fabric from said fabric roll holder at said front surface, wherein said bottom surface gradually applies said sheet of fabric over said roof deck when said frame is moved across said roof deck.

2. The apparatus of claim 1, wherein said mould element is positioned inside a mould container having inner width and length greater than the width and length of said mould element allowing said mould element to move inside said mould container.

3. The apparatus of claim 2, further comprising a detent arrangement allowing a portion of said mould element to hang from said mould container without completely falling out of said mould container.

4. The apparatus of claim 3, wherein the contour of said bottom surface is selected to conform to the surface profile of said roof deck.

5. The apparatus of claim 1, wherein said mould element comprises a plurality of removable mould blocks positioned side-by-side.

6. The apparatus of claim 1, wherein said mould element is positioned inside a mould container.

7. The apparatus of claim 6, further comprising a straightening element coupled to said mould container so that said sheet of fabric is straighten prior to be received at said front surface.

8. The apparatus of claim 7, further comprising at least one tension element structurally coupled to said frame to maintain tension on the fabric sheet, wherein said at least one tension element is selectively positioned on said frame so that said fabric sheet makes a turn across said straightening element at an angle of at least 90°.

9. The apparatus of claim 6, wherein the distance between said mould container and said roof deck is selectively adjustable.

10. The apparatus of claim 1, further comprising at least one tension element structurally coupled to said frame to maintain tension on the fabric sheet.

11. The apparatus of claim 1, further comprising a plurality of wheels structurally coupled to each lateral side of said frame, wherein the distance between the plurality of wheels of each lateral side is selectively adjustable.

12. The apparatus of claim 1, further comprising an embedding brush positioned behind the rear surface of said mould element, wherein said embedding brush passes over said sheet of fabric as the sheet of fabric leaves the mould element.

13. The apparatus of claim 1, further comprising at least one sprayer tip directed towards said roof deck for applying a liquid adhesive to said roof deck, wherein said at least one sprayer tip is structurally coupled to a front side of a second frame.

14. The apparatus of claim 13, wherein the horizontal distance between said at least one sprayer tip and said front side of said second frame is selectively adjusted by means of a horizontal adjusting element; the vertical distance between said at least one sprayer tip and said roof deck is selectively adjusted by means of a vertical adjusting element; and the distance between said at least one sprayer tip and a center point of the front side of said second frame is selectively adjusted by means of a central adjusting element.

15. The apparatus of claim 13, wherein the angle at which said at least one sprayer tip directs said liquid adhesive towards said roof deck is selectively adjusted by means of an angle-adjusting element.

16. The apparatus of claim 13, further comprising a plurality of wheels structurally coupled to each lateral side of said second frame, wherein the distance between the plurality of wheels of each lateral side is selectively adjustable.

17. A method for applying a sheet of fabric from a roll of fabric across a surface of a roof deck having a surface profile, the method comprising:

placing said sheet of fabric over a profile of said roof deck;

positioning an applying apparatus over said sheet of fabric placed over said profile of said roof deck, said applying apparatus having: a frame that includes a fabric roll holder supporting said fabric roll; a mould element structurally coupled to said frame and having a top surface, a front surface, a rear surface, lateral surfaces and a bottom surface having a contour that conforms to the surface profile of said roof deck, said bottom surface facing said roof deck and longitudinally extending between said front surface and said rear surface of said mould element, wherein the distance between said bottom surface and said roof deck longitudinally decreases from said front surface to said rear surface so that the distance between said front surface and said roof deck is greater than the distance between said rear surface and said roof deck; and moving said applying apparatus so that said mould element receives at said front surface said sheet of fabric from said fabric roll holder, wherein said bottom surface gradually applies said sheet of fabric over said profile of said roof deck when said applying apparatus is moved across said roof deck.

18. The method of claim 17, further comprising selectively adjusting the distance between a plurality of wheels structurally coupled to each lateral side of said frame so that another profile serves as guiding means when said applying apparatus is moved across said roof deck.

19. The method of claim 17, further comprising selectively adjusting the distance between said roof deck and a mould container having said mould element within.

20. The method of claim 19, further comprising positioning said mould element inside said mould container prior to positioning the applying apparatus over said sheet of fabric, wherein said mould element is allowed to move inside said mould container, said mould container has an inner width and length greater than the width and length of said mould element.

21. The method of claim 20, wherein the step of positioning said mould element inside said mould container comprises positioning a plurality of removable mould blocks side-by-side.

22. The method of claim 17, further comprising directing at least one sprayer tip structurally coupled to a front side of a second frame towards said roof deck for applying a liquid adhesive to said roof deck.

23. The method of claim 22, further comprising selectively adjusting at least one of: the horizontal distance between said at least one sprayer tip and said front side of said second frame, the vertical distance between said at least one sprayer tip and said roof deck, and selectively adjusting the distance between said at least one sprayer tip and a center point of the front side of said second frame.

24. The method of claim 22, further comprising selectively adjusting the angle at which said at least one sprayer tip directs liquid adhesive towards said roof deck.

25. The method of claim 17, further comprising selectively adjusting the distance between a plurality of wheels structurally coupled to each lateral side of said second frame so that another profile serves as guiding means when said second frame is moved across said roof deck to spray liquid adhesive towards said roof deck.

26. The method of claim 17, further comprising applying liquid adhesive to said roof deck prior to applying said sheet of fabric to said roof deck.

27. The method of claim 17, further comprising applying liquid adhesive to said roof deck after applying said sheet of fabric to said roof deck.

* * * * *